United States Patent [19]

Kumar et al.

[11] Patent Number: 4,897,283

[45] Date of Patent: Jan. 30, 1990

[54] PROCESS OF PRODUCING ALIGNED PERMANENT MAGNETS

[75] Inventors: Kaplesh Kumar, Wellesley; Dilip K. Das, Bedford, both of Mass.

[73] Assignee: The Charles Stark Draper Laboratory, Inc., Cambridge, Mass.

[21] Appl. No.: 70,634

[22] Filed: Jul. 6, 1987

Related U.S. Application Data

[60] Continuation-in-part of Ser. No. 814,012, Dec. 20, 1985, abandoned, Continuation of Ser. No. 632,681, Jul. 20, 1984, abandoned, Division of Ser. No. 467,132, Feb. 16, 1983, abandoned.

[51] Int. Cl.[4] ..... B05D 1/00; B05D 5/12

[52] U.S. Cl. ..... 427/34; 427/128; 427/129; 427/130; 427/132; 427/191; 427/197; 427/282; 427/283; 427/423; 427/427

[58] Field of Search ..... 427/34, 48, 128, 129, 427/132, 130, 189, 191, 422, 423, 427, 282, 283

[56] References Cited

U.S. PATENT DOCUMENTS

| | | | |
|---|---|---|---|
| 3,576,672 | 4/1971 | Harris et al. | 427/34 |
| 3,856,579 | 12/1974 | Allen et al. | 148/31.57 |
| 3,929,519 | 12/1975 | Benz | 148/31.57 |
| 3,956,031 | 5/1976 | Marcus | 148/31.57 |
| 3,985,588 | 10/1976 | Lyman | 148/31.57 |
| 4,042,341 | 8/1977 | Smeggil | 428/900 |
| 4,076,561 | 2/1978 | Lee et al. | 148/31.57 |
| 4,116,726 | 9/1978 | Menth et al. | 148/31.57 |
| 4,141,943 | 2/1979 | Houska | 148/31.57 |
| 4,297,388 | 10/1981 | Kumar et al. | 427/47 |
| 4,322,257 | 3/1982 | Menth et al. | 148/31.57 |

OTHER PUBLICATIONS

C. Herget and H.-G. Domazer, "Methods for the Production of Rare Earth-3d Metal Alloys with Particular Emphasis on the Cobalt Alloys," published by Goldschmidt, Dec. 1975.

B. D. Cullity, Chapter 6 entitled, "Ferrimagnetism," in the book Introduction to Magnetic Materials, published by Addison-Wesley Publishing Company.

K. Kumar, D. Das, and E. Wettstein, *J. Appl. Phys.*, 49, 2052 (1978).

K. Kumar and D. Das, *Thin Solid Films*, 54, 263 (1978).

K. Kumar, D. Das, and R. Williams, *J. Appl. Phys.*, 51, 1031 (1980).

Report CSDL-R-1614, "Rare Earth Magnetic Material Technology as Related to Gyro Torquers and Motors," Dec. 1982.

K. J. Strnat, Recent Developments in the Field of Rare Earth Magnets and Their Uses in the USA, Proceedings of the 6th International Workshop on Rare Earth-Cobalt Permanent Magnets, held Aug. 31-Sep. 2, 1982.

K. Kumar and D. Das, *J. Appl. Phys.*, 60, 3779 (1986).

Entries from a technical dictionary on magnetically-related terms and hysteresis.

*Primary Examiner*—Bernard Pianalto

*Attorney, Agent, or Firm*—Weingarten, Schurgin, Gagnebin & Hayes

[57] ABSTRACT

A highly aligned rare-earth transition metal alloy magnet material such as samarium-cobalt ($SmCo_5$). The high degree of alignment is evidenced by an isolated X-ray diffraction pattern peak for $Cu_{k\alpha}$ radiation at a interplane "d" spacing of 2.0 A° and is produced by very high temperature deposition of the material on a hot surface. The surface temperature is maintained well above 800 degrees centigrade and most preferably is initially set at approximately 1020 degrees centigrade or higher at which temperature the isolated diffraction pattern peak dominates. A higher temperature typically occurs during deposition. Deposition of the material on the surface typically takes place by application of the material as a fine, homogeneously sized powder to the plasma flame of a plasma torch. The surface may be preheated by the application of the plasma flame to the surface without the application of the powdered material. A feedback controlled auxiliary heat source may also be used to facilitate maintaining the temperature of the surface at the very high temperature level.

11 Claims, 3 Drawing Sheets

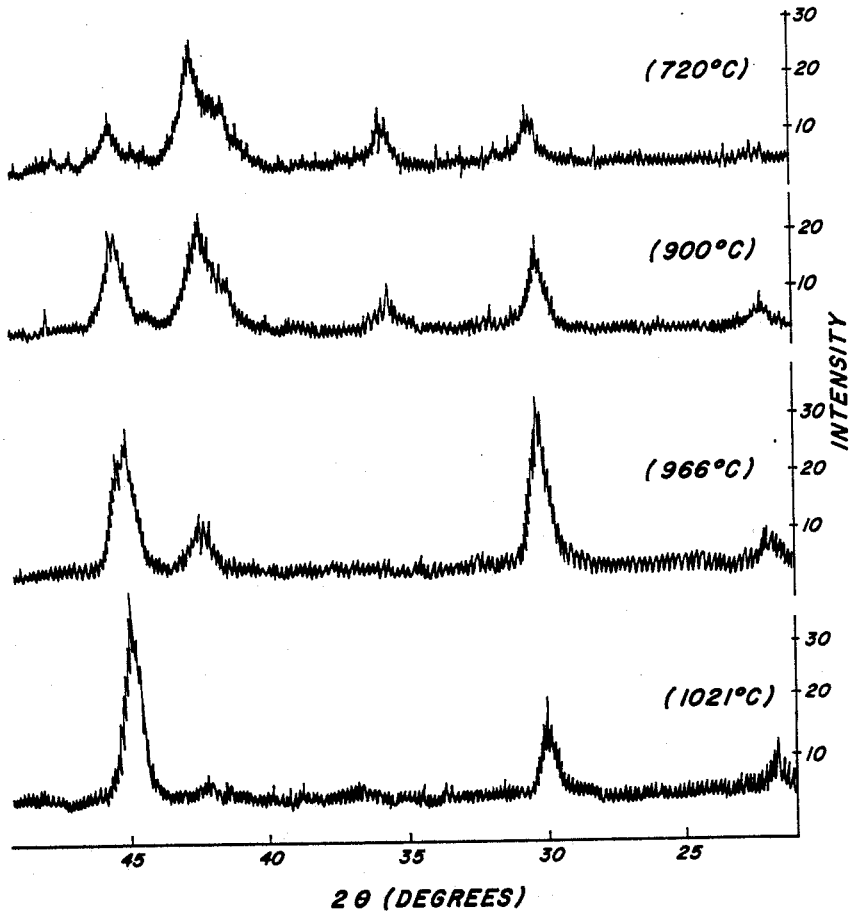
FIG. 1A
FIG. 1B
FIG. 1C
FIG. 1D
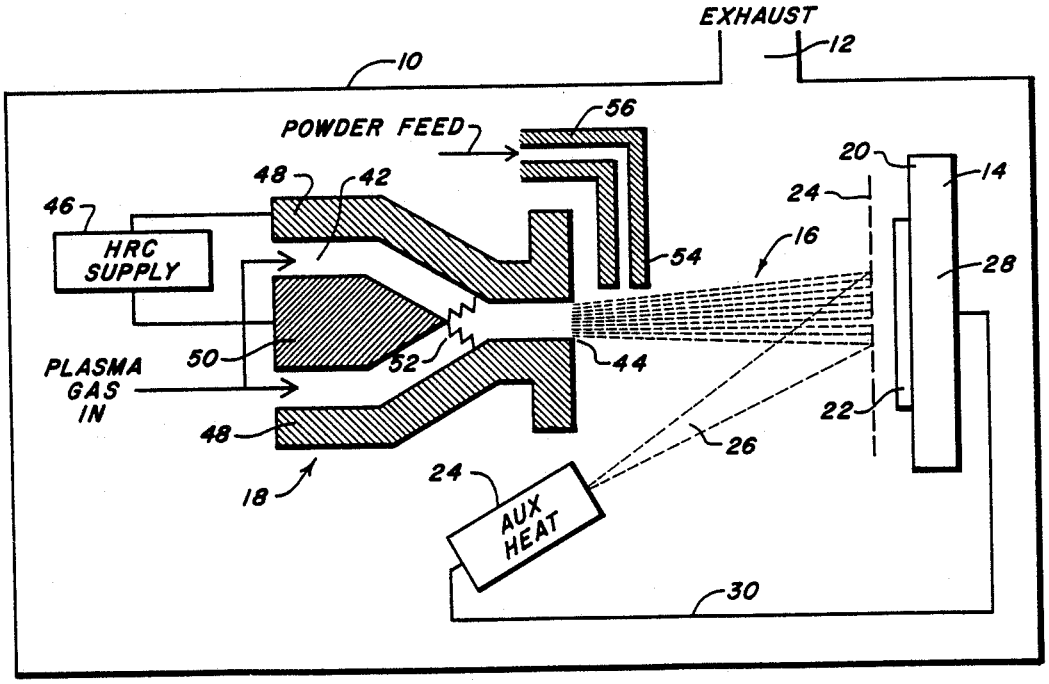
FIG. 2

PROCESS OF PRODUCING ALIGNED PERMANENT MAGNETS

This application is continuation-in-part of application Ser. No. 814,012, filed Dec. 20, 1985, which was a continuation of application Ser. No. 632,681, filed July 20, 1984, which was a division of application Ser. No. 467,132, filed Feb. 16, 1983.

FIELD AND BACKGROUND OF THE INVENTION

The present invention relates to the production of rare-earth transition metal magnets. Such magnets and a process for their preparation are described in our U.S. Pat. No. 4,297,388, specifically incorporated herein by reference and commonly assigned with this application. The magnets made by such a technique have high coercivities, a magnetic remanence characteristic of isotropic material and exhibit good flux stabilities. Such magnets are in great demand in applications requiring small, light and strong magnets. Typical among the applications for this type of magnet are small D.C. motors and generators, multipole ring magnets for use in many areas including inertial instruments, loudspeakers, travelling wave tubes, magnetic bearings, brakes and clutches, and actuators and sensors in general.

In the production of small strong magnets, an important feature for the material forming the magnet to exhibit is a high degree of crystallographic alignment. It is this alignment that determines the degree to which the available microstructure dipoles participate in or contribute to the magnetic field produced by the permanent magnet.

BRIEF SUMMARY OF THE INVENTION

In accordance with the teaching of the present invention, a permanent magnet material and a process for its preparation are disclosed in which very high degrees of alignment of the microstructure of the material are achieved as a result of the particular processing used to produce it. The magnet material is a rare-earth transition metal alloy such as samarium-cobalt ($SmCo_5$). The magnet is produced in a form for use as a permanent magnet by producing a deposition on a surface resulting from the application of fine, homogeneously sized powder to a plasma flame directed at the surface. The surface temperature is maintained in a very hot state during the deposition process. This temperature is well above 800 degrees centigrade and appears to be most preferably set initially before deposition at 1020 degrees centigrade or above, where alignment of the deposit, as detected by X-ray diffraction patterns, appears to be very high and the material is still well below its melting temperature. A higher temperature may occur during deposition itself. The high level of alignment is confirmed by the presence of an isolated peak at 2.0 A° in the interplane "d" spacing in the X-ray diffraction pattern from $Cu_{k\alpha}$ radiation.

In order to achieve this high temperature condition, the deposition surface can optionally be preheated by the plasma flame before the application of the powder thereto. An auxiliary heater in the nature of a heating element adjacent to the surface or laser beam directed at the surface may be used to maintain this elevated temperature, and a feedback control used for temperature regulation.

Subsequent to the deposition of the material from the plasma torch, an optimizing heat treatment step can be added, cycling the deposition through a high temperature exposure followed by a lower temperature (typically 900 degrees or above) aging for a longer time period. The deposition procedure is preferably conducted in an environmentally controlled plasma spray chamber having an exhaust for waste materials desired due to reactivity of these materials at the high temperatures involved.

The starting material in the case of samarium-cobalt is a powdered alloy of the two materials enriched in samarium to accommodate its evaporation in the deposition process that results from the elevated temperatures used to achieve a high degree of alignment.

DESCRIPTION OF THE DRAWING

These and other features of the present invention are more fully set forth below in the solely exemplary detailed description and accompanying drawing of which:

FIGS. 1A–1E are diagrams of X-ray diffraction patterns of material produced in accordance with the invention demonstrating the high degree of alignment achieved at elevated temperatures;

FIG. 2 is a diagram of apparatus for practicing the present invention; and

DETAILED DESCRIPTION OF THE INVENTION

The present invention contemplates the production of highly aligned permanent magnet material such as samarium-cobalt ($SmCo_5$). The permanent magnet material is produced by deposition of an alloy on a highly heated substrate surface. A plasma flame is directed at the surface and fed with a powder of a rare-earth transition metal alloy resulting in the deposition out of the flame onto the surface of the alloy material.

Figure 1E:
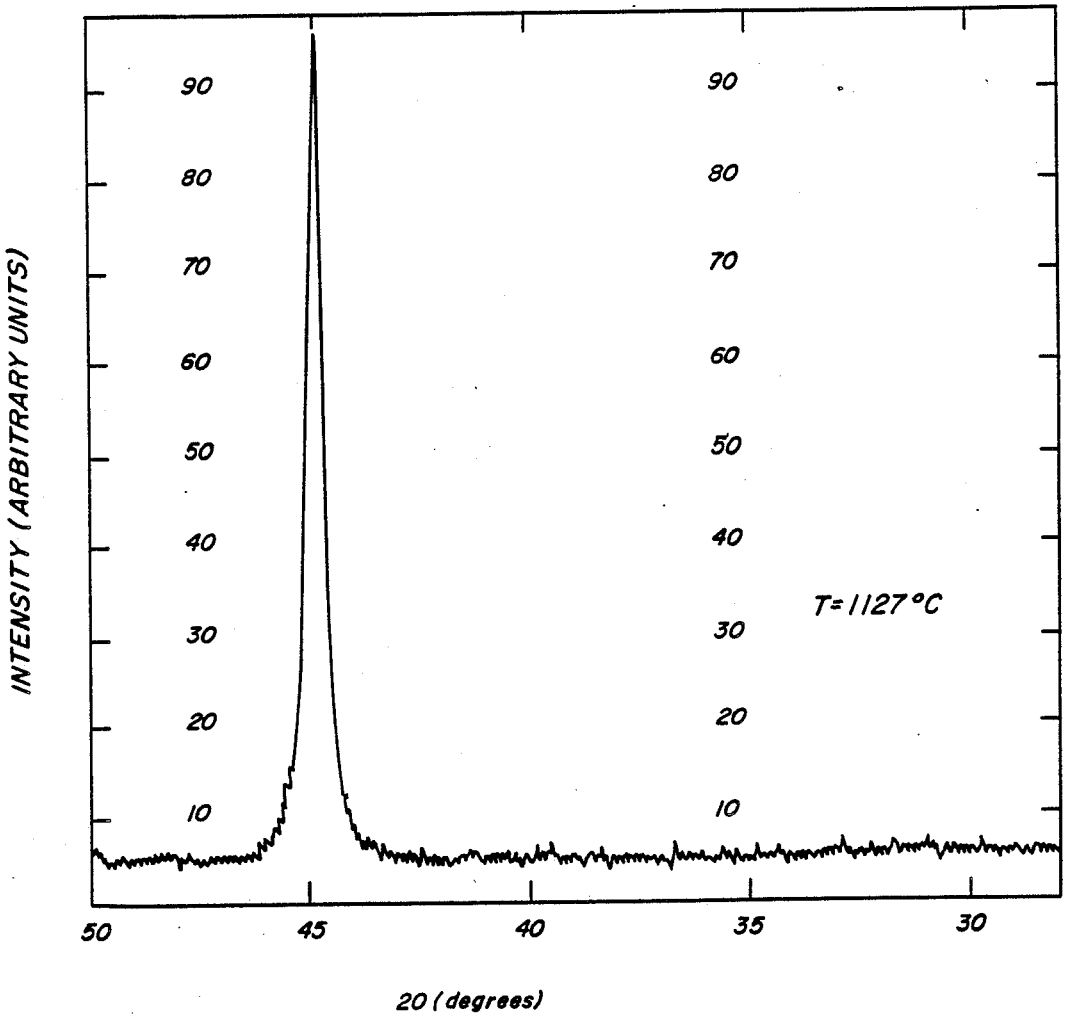

It has been discovered from X-ray diffraction pattern analysis of permanent magnet materials deposited from a plasma flame that at very high substrate surface temperatures, a high degree of alignment begins to appear. This alignment is detected by observing the scattering angle in the diffraction pattern at which intensity peaks of scattered X-rays are detected. FIGS. 1A–1E illustrate this effect. In FIG. 1A a diffraction pattern is shown taken of material deposited on a substrate initially set at 720° C. prior to deposition while FIGS. 1B, 1C, and 1D illustrate patterns for materials respectively deposited at initial substrate temperatures of 900° C., 966° C., and 1021° C. respectively. FIG. 1E is a diffraction pattern of material deposited on a substrate initially set at approximately 1127° C., and shows the deposited material has nearly perfect crystallographic alignment. During deposition the actual substrate temperature would be expected to rise significantly.

Where the C-axis alignment of most of the material deposited upon a surface in accordance with the present invention is perpendicular to the surface, a strong diffraction pattern peak to $Cu_{k\alpha}$ radiation will be exhibited at 2.0° A interplane "d" spacing, the 002 state shown in the figures. This corresponds to a Bragg angle, when doubled, of 45.3 degrees. The plots shown in FIGS. 1A–1E illustrate the scattering angle intensities of such material produced at the different temperatures noted. The evolution of the X-ray pattern from a generally meaningless pattern of scattering angles at 720° C. in FIG. 1A to the appearance of a dominant 002 state peak above that temperature in FIGS. 1B, 1C, 1D and 1E can be clearly seen. These plots represent actual X-ray patterns produced for the assignee Laboratory. At 966° C. and particularly at 1021° C., the 002 state peak becomes isolated and dominant, indicating a strong alignment of the material C-axis along a single line parallel to a line perpendicular to the deposition surface. At an initial substrate temperature of 1127° C. the crystallographic alignment is nearly perfect. Note that the degree of alignment increases with increasing substrate temperature. It is believed that material deposited at even higher substrate temperatures than 1127° C. would also exhibit nearly perfect crystallographic alignment. The upper temperature limit for the process would then be the lower of the temperatures at which the substrate and the deposition material melt. This temperature would be a function of the actual materials used for the substrate and the deposit. Material deposited with this characteristic of very high crystallographic alignment is particularly useful for permanent magnets because of its ability to produce strong and stable magnets having high coercivity and magnetic remanence.

FIG. 2 illustrates apparatus for producing the highly aligned permanent magnet material of the present invention. The apparatus is preferably contained within an environmentally controlled chamber 10 having an exhaust 12 for the very hot and reactive gases generated in the production of the magnet material. Within the chamber 10 a substrate 14 is positioned to receive material from a plasma flame 16 produced by a plasma torch 18. The substrate 14 has a surface 20 on which a deposition 22 collects by solidification of material carried by the flame 16. A mask 24 may be provided to produce a desired pattern of deposited material in the deposition 22 on surface 20. The substrate 14 may be rotated or translated back and forth, or both, for the purpose of increasing the homogeneity of the deposition 22 as is known in the art. The substrate may also be a rotating cylinder, masked to produce deposition shapes corresponding to radially aligned magnets. The substrate material may include a structure intended for use as a part of the magnet assembly in the product application.

The surface 20 of the substrate 14 can be additionally and optionally heated by an auxiliary heat source in order to maintain and regulate the high surface temperatures above 800 degrees C., preferably above 966° C., and most preferably 1020° C. or higher. The auxiliary heat source can be a heating element in the substrate 14 or a laser heater such as laser heat source 25. In the case of a laser heat source 25, a heating beam 26 from the laser 25 is directed toward the deposition 22 on the surface of the substrate 14. A temperature sensor 28 is preferably provided and may be located within the substrate 14 to detect the temperature of the deposition 22. A signal representing the detected temperature is applied from the sensor 28 over a feedback path 30 to the laser source 25. This signal is applied within the laser 25 to control its output in a manner to regulate the temperature of the deposition 22 to the desired temperature well above 800° C. in accordance with the intended operating point for the growth of the deposition 22.

The plasma torch 18 includes a nozzle 40 having an annular passage 42 through which an inert gas such as argon or helium or both is applied to exit through an orifice 44, directed toward the substrate 14. An electric arc supply 46 applies a high voltage to separate electrodes 48 and 50 which define between them the annular passage 42. The applied potential creates an arc 52 between the electrodes just inside the orifice 44. The arc 52 energy ionizes the gas and thus greatly elevates its temperature. The resulting high temperature plasma is directed toward the substrate as the flame 16.

Powdered material is applied to the plasma flame 16 just beyond the orifice 44 from a powder dispensing orifice 54 placed directly above the plasma flame 16. The powdered material is applied to the orifice 54 through a conduit 56 at a desired feed rate as is known in the art of plasma deposition.

In the case where the desired deposition 22 is to be samarium-cobalt ($SmCo_5$), the powder feed is a finely divided alloy of samarium and cobalt with a particle size preferably held to approximately 40 microns plus or minus 20 microns. Close control over the particle size is of advantage in the production of a uniform deposition 22. The alloy of the powder feed is also preferably enriched in samarium to approximately 38 to 45 weight percentage to account for the evaporation of the samarium at the high deposition temperatures employed in the invention.

Figure 3:
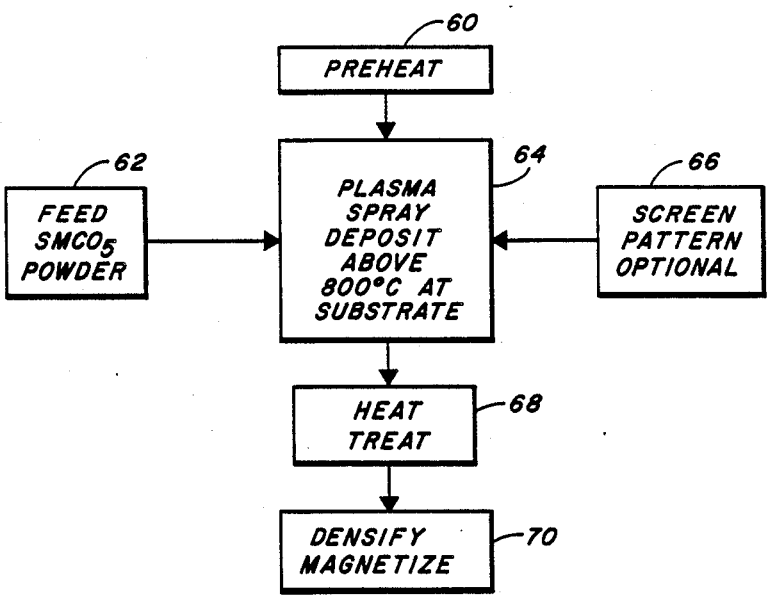
FIG. 3 is a flow chart illustrating exemplary steps used in the process of producing an aligned permanent magnet material according to the present invention.

As illustrated in FIG. 3, the process of depositing a rare-earth transition metal alloy material according to the invention preferably uses an optional preheating step 60 in which the plasma flame 16 is directed toward the surface 20 of the substrate 14 without any powdered alloy feed in order to raise the surface 20 temperature to the desired level. Auxiliary heating may then also be used to maintain and regulate that temperature. Once the desired temperature is reached, a step 62 activates the powdered alloy feed and, in a step 64, the process of growing the deposition 22 proceeds. Optionally, the growth of the deposition 22 is produced in a desired pattern by applying the plasma flame 16 through mask 24 using a screening step 66 as a part of the step 64. As noted above, at the highly elevated temperatures employed in the invention, the deposition 22 will grow with the C-axis perpendicular to the surface 20, resulting in a highly aligned deposition.

Once the deposition 22 has grown to the desired size, subsequent processing preferably includes an optional heat treating step 68 which temperature cycles the deposition for the purpose of homogenizing and aging it. In one case the heat treating step includes exposing the deposition 22 to a temperature in the range of 900° C. to 1150° C. for periods varying with the temperature, 50–100 hours being typical at 1000° C. In another case, the deposition 22 is first exposed to a very high temperature, below the melting temperature of samarium, for a short period of, for example 2 hours, and subsequently aged at, for example, 900° C. for 10 to 50 hours.

After the heat treating step 68, final processing by densification such as by hot isostatic pressing and magnetization as are known in the art are typically and optionally accomplished in a step 70.

By patterning the deposition 22 various functions can be achieved all within the single step of growing a highly aligned permanent magnet material. One example of such efficiency is the production of uniform radially aligned magnet rings for use in rotary instruments using an appropriately patterned and masked deposition on the sides of a rotating cylinder.

The above described process and apparatus are exemplary only of the manner in which highly aligned permanent magnet material may be produced according to the invention. The following claims are intended as the sole definition of the scope of that invention.

What is claimed is:

1. A process for producing highly crystallographically aligned permanent magnet material comprising the steps of:

directing a spray of molten particulate rare earth-transition metal alloy toward the surface of a heated substrate;

depositing said molten particulate alloy on said surface; and maintaining the temperature of said surface above approximately 966° but below the lower of the melting points of the substrate and the deposition material during the deposition so as to achieve a high degree of crystallographic alignment and corresponding high magnetic anisotropy in the deposition material.

2. The process of claim 1 wherein in said maintaining step the surface temperature of the substrate is maintained at or above 1000 degrees centigrade.

3. The process of claim 1 wherein in said maintaining step the surface temperature of the substrate is maintained at or above approximately 1020 degrees centigrade.

4. The process of claim 1 further including the step of heat treating the deposited material subsequent to said deposition step, to improve the coercivity of the deposited material.

5. The process of claim 4 wherein said heat treating step includes the steps of:

treating the deposited material at a high temperature below its melting point for a predetermined time period followed by a lower temperature treating at a temperature of at least 900° C. for a longer time than said predetermined time period.

6. The process of claim 4 wherein said heat treating step includes the step of treating the deposited material at 900° C. to 1150° C. for a predetermined time period.

7. The process of claim 1 wherein said material is samarium-cobalt ($SmCo_5$).

8. The process of claim 1 wherein said maintaining step further includes the step of providing auxiliary heat to said surface controlled to achieve said temperature above approximately 966 degrees centigrade.

9. The process of claim 1 wherein said depositing step further includes the step of depositing said material in a pattern through a mask defining said pattern.

10. The process of claim 9 wherein said depositing step includes the step of depositing radially aligned rings of material.

11. The process of claim 1 wherein in said maintaining step, the surface temperature of the substrate is maintained at or above 1127 degrees centigrade.

* * * * *

UNITED STATES PATENT AND TRADEMARK OFFICE

CERTIFICATE OF CORRECTION

PATENT NO. : 4,897,283

DATED : January 30, 1990

INVENTOR(S) : Kaplesh Kumar

It is certified that error appears in the above-identified patent and that said Letters Patent is hereby corrected as shown below:

In the Abstract, line 10, "temperature" should read --temperatures--.

Signed and Sealed this

Twenty-fifth Day of January, 1994

Bruce Lehman

*Attest:*

BRUCE LEHMAN

*Attesting Officer*

*Commissioner of Patents and Trademarks*